US011834769B2

(12) United States Patent
Harbrecht et al.

(10) Patent No.: US 11,834,769 B2
(45) Date of Patent: Dec. 5, 2023

(54) LAUNDRY TREATING APPLIANCE WITH DISPENSER HAVING A SIPHON CAP

(71) Applicant: WHIRLPOOL CORPORATION, Benton Harbor, MI (US)

(72) Inventors: Ethan Harbrecht, Michigan City, IN (US); Douglas Mikkelsen, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 114 days.

(21) Appl. No.: 17/404,648

(22) Filed: Aug. 17, 2021

(65) Prior Publication Data

US 2021/0372025 A1 Dec. 2, 2021

Related U.S. Application Data

(63) Continuation of application No. 16/263,931, filed on Jan. 31, 2019, now Pat. No. 11,111,622, which is a continuation of application No. 15/137,198, filed on Apr. 25, 2016, now Pat. No. 10,253,443.

(51) Int. Cl.

| | |
|---|---|
| ***D06F 39/02*** | (2006.01) |
| ***D06F 37/28*** | (2006.01) |
| *D06F 39/14* | (2006.01) |

(52) U.S. Cl.

CPC ..... *D06F 39/02* (2013.01); *D06F 37/28* (2013.01); *D06F 39/022* (2013.01); *D06F 39/14* (2013.01)

(58) Field of Classification Search

CPC ..... D06F 37/28; D06F 39/02; D06F 39/022; D06F 39/14

See application file for complete search history.

(56) References Cited

U.S. PATENT DOCUMENTS

| | | | | |
|---|---|---|---|---|
| 6,327,729 | B1 | 12/2001 | Wunderlich et al. | |
| 7,421,867 | B2 * | 9/2008 | Bongini | D06F 39/02 68/17 R |
| 2004/0172770 | A1 | 9/2004 | Heo et al. | |
| 2004/0216499 | A1 | 11/2004 | Bongini | |
| 2005/0144737 | A1 * | 7/2005 | Roepke | D06F 39/022 68/17 R |
| 2005/0229652 | A1 | 10/2005 | Kim et al. | |
| 2005/0235704 | A1 | 10/2005 | Cho et al. | |
| 2006/0053842 | A1 | 3/2006 | Je | |

(Continued)

FOREIGN PATENT DOCUMENTS

| | | | |
|---|---|---|---|
| EP | 1445368 | A2 | 8/2004 |
| EP | 2013400 | B1 | 3/2012 |

(Continued)

OTHER PUBLICATIONS

European Search Report for Counterpart 17158180.4, dated Aug. 28, 2017.

*Primary Examiner* — Joseph L. Perrin
(74) *Attorney, Agent, or Firm* — McGarry Bair PC

(57) ABSTRACT

The disclosure relates to a washing machine including a cabinet defining a housing with internal components of a conventional automated clothes washer, a treating chamber, and a dispenser having at least one reservoir with a base, an open top, and a siphon tube extending from the base. The dispenser fluidly coupled to the treating chamber. A funnel closing the open top and having a collar around the siphon tube.

20 Claims, 5 Drawing Sheets

(56) References Cited

U.S. PATENT DOCUMENTS

| | | | | |
|---|---|---|---|---|
| 2007/0022788 | A1 | 2/2007 | Choi et al. | |
| 2007/0044517 | A1* | 3/2007 | Yang | D06F 39/022 68/17 R |
| 2007/0240456 | A1 | 10/2007 | Byun et al. | |
| 2009/0158782 | A1* | 6/2009 | Hill | D06F 39/02 222/630 |
| 2011/0277515 | A1 | 11/2011 | Doh | |
| 2013/0160215 | A1 | 6/2013 | Anderson et al. | |
| 2015/0135780 | A1 | 5/2015 | Ajiki et al. | |
| 2016/0090681 | A1 | 3/2016 | Nash et al. | |
| 2017/0143184 | A1* | 5/2017 | Wegener | D06F 39/026 |
| 2017/0268152 | A1 | 9/2017 | Leibman et al. | |
| 2017/0298562 | A1* | 10/2017 | Leibman | D06F 39/02 |

FOREIGN PATENT DOCUMENTS

| | | | |
|---|---|---|---|
| EP | 2743393 | A1 | 6/2014 |
| EP | 2633115 | B1 | 2/2016 |
| WO | 2007122484 | A2 | 11/2007 |
| WO | 2008068559 | A1 | 6/2008 |

* cited by examiner

LAUNDRY TREATING APPLIANCE WITH DISPENSER HAVING A SIPHON CAP

CROSS-REFERENCE TO RELATED APPLICATIONS

This application is a continuation of U.S. patent application Ser. No. 16/263,931, filed Jan. 31, 2019, now U.S. Pat. No. 11,111,622, issued Sep. 7, 2021, which is a continuation of U.S. patent application Ser. No. 15/137,198, filed Apr. 25, 2016, now U.S. Pat. No. 10,253,443, issued Apr. 9, 2019, both of which are incorporated herein by reference in their entirety.

BACKGROUND

Laundry treating appliances, such as clothes washers, refreshers, and non-aqueous systems, can have a configuration based on a rotating drum that defines a treating chamber having an access opening through which laundry items are placed in the treating chamber for treating. The laundry treating appliance can have a controller that implements a number of pre-programmed cycles of operation having one or more operating parameters.

In some laundry treating appliances, the dispenser is mounted to an inner surface of a door closing the access opening to the treating chamber. Such dispensers typically have one or more reservoirs or cups in which single doses of treating chemistry can be received when the door is open. When the door is closed, the door is subjected to strong inertial forces, especially when the door stops upon reaching the closed position, which can cause the treating chemistries in the cups to slosh out. This sloshing effect will also occur when the door is opened before a wash cycle begins, resulting in the fluids to fall to the floor when the operator stops the swinging motion of the door in the open position.

BRIEF SUMMARY

Aspects of the present disclosure relate to a laundry treating appliance for treating laundry according to an automatic cycle of operation, comprising a cabinet defining an interior with an opening providing access to the interior; a treating chamber located within the cabinet and accessible by the opening; a dispenser having at least one reservoir with a base and an open top and a siphon tube extending from the base and fluidly coupled to the treating chamber; a siphon cap received in the open top of the reservoir, the siphon cap comprising a funnel closing the open top and extending between an inlet and a bottom of the funnel, and a collar extending from the bottom of the funnel around the siphon tube.

Another aspect of the present disclosure relates to a dispenser for a household appliance for treating an article according to an automatic cycle of operation, the dispenser comprising at least one reservoir with a base and an open top; a siphon tube extending from the base; and a siphon cap received in the open top of the reservoir, the siphon cap comprising a funnel closing the open top and extending between an inlet and a bottom of the funnel, and a collar extending from the bottom of the funnel around the siphon tube.to the rear face, and a funnel closing the open-top of the reservoir, and a window located on the dispenser and providing a view of at least a portion of the open-top reservoir.

DETAILED DESCRIPTION

Figure 1:
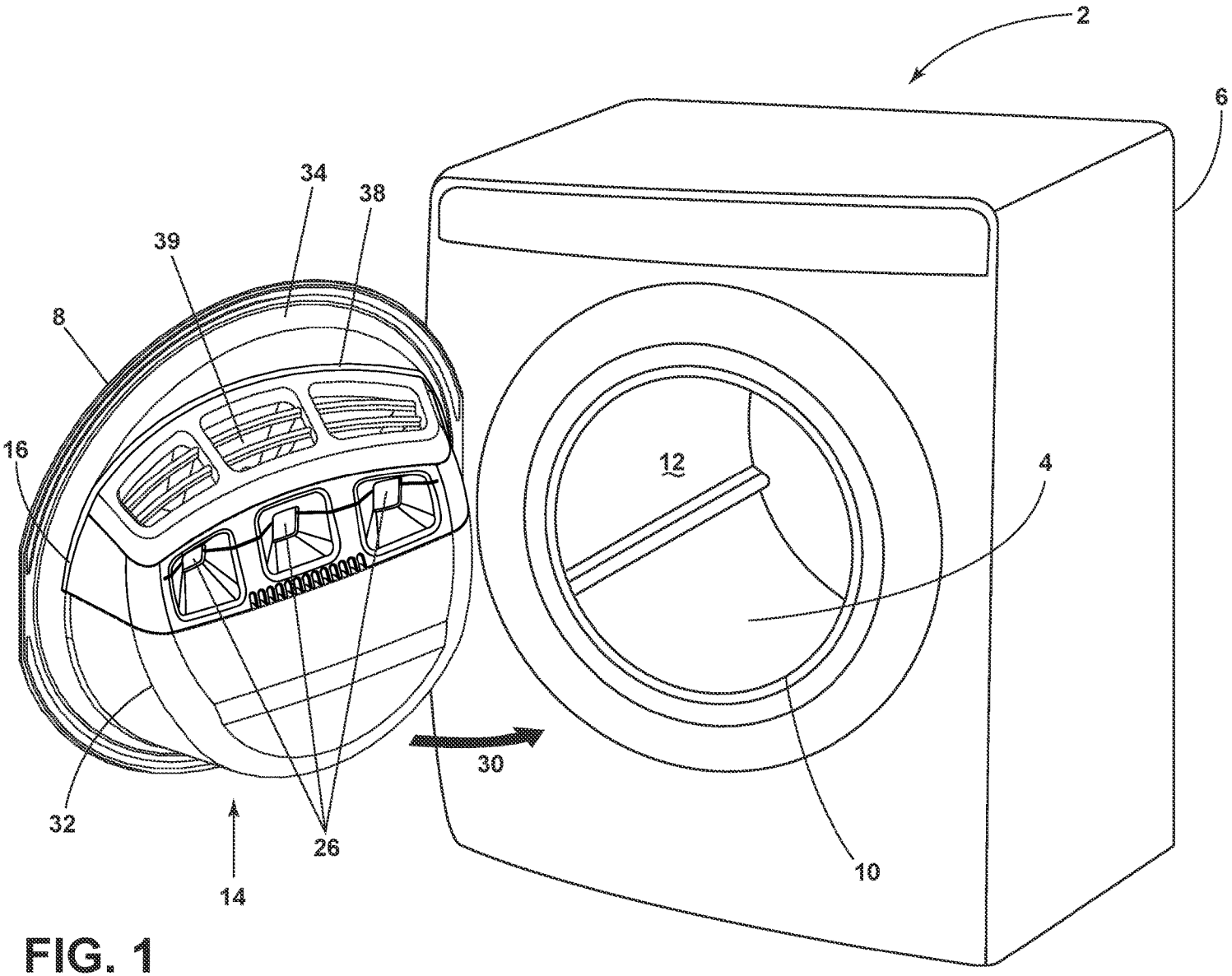
FIG. 1 is a perspective view of a laundry treating appliance in the form of an automatic washing machine with a closure, in the form of a door, in an open position.

Referring now to FIG. 1, a first embodiment in accordance with the present disclosure may be illustrated as a laundry treating appliance in the environment of a horizontal axis automatic clothes washing machine 2. Although much of the remainder of this application will focus on the embodiment of an automatic clothes washing machine, the illustrative embodiments may have utility in other environments, including other horizontal axis laundry treating appliances or other front loading appliances. Depending on the configuration, it is possible for the embodiments to have applicability in vertical axis washing machines and other top loading appliance.

In addition to or in lieu of the general orientation of the axis of rotation, horizontal and vertical axis washing machines can also be distinguished by the primary way in which they impart mechanical energy to the laundry. The horizontal axis washing machine imparts mechanical energy by tumbling the laundry within the drum. The vertical axis washing machine imparts mechanical energy via a clothes mover, such as an agitator, impeller, pulsator, auger, etc., which is rotated within the basket to effect movement of liquid in the basket or directly impact the laundry. While a laundry container is normally referred to as a drum for a horizontal axis machine and a basket for a vertical axis machine, for this disclosure, unless otherwise stated, drum and basket are interchangeable.

The washing machine 2 shares many features of a conventional automated clothes washer, which will not be described in detail herein except as necessary for a complete understanding of the illustrative embodiments in accordance with the present disclosure. The washing machine 2 has a rotatable drum 4 that defines a treating chamber 12 for receiving the laundry and rotates about a generally horizontal axis. Examples of articles include, but are not limited to, a hat, a scarf, a glove, a sweater, a blouse, a shirt, a pair of shorts, a dress, a sock, and a pair of pants, a shoe, an undergarment, and a jacket. One or more articles form a laundry load.

A tub 5 receives the drum 4 and holds liquid for use in a treating cycle of operation. The tub 5 can rotatably mount the drum 4. A cabinet 6 can define a housing within which a suspension system is provided for suspending the tub 5 within the cabinet 6. The cabinet 6 can be a housing having a chassis and/or a frame, defining an interior, enclosing components typically found in a conventional washing machine, such as motors, pumps, fluid lines, controls, sensors, transducers, and the like. Such components will not be described further herein except as necessary for a complete understanding of the disclosure.

A closure in the form of a door 8 may be mounted to the cabinet 6 via a vertical axis hinge. The door 8 moves along a path of travel 30 to selectively close an access opening 10 to the treating chamber 12. Both the tub 5 and a drum 4 may be located within the interior of the cabinet 6. The tub 5 may be associated with a sump for holding a liquid used during a cleaning cycle. The sump may be normally connected to a drain (not shown) to provide a flow path for removing the liquids.

The washing machine 2 can also be provided with a dispenser 16 for dispensing treating chemistry to the treating chamber 12 for use in treating the laundry according to a cycle of operation. The dispenser 16 illustrated in FIG. 1 is formed integrally with the rear face 14 of the door 8. The dispenser 16 is illustrated as a single use dispensing assembly. However, a bulk dispenser may be provided integrated with or separate from the single use dispenser 16.

Non-limiting examples of treating chemistries that can be dispensed by the dispenser 16 during a cycle of operation include one or more of the following: water, detergents, softeners, bleach, rinse aids, surfactants, enzymes, fragrances, stiffness/sizing agents, wrinkle releasers/reducers, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

Figure 2:
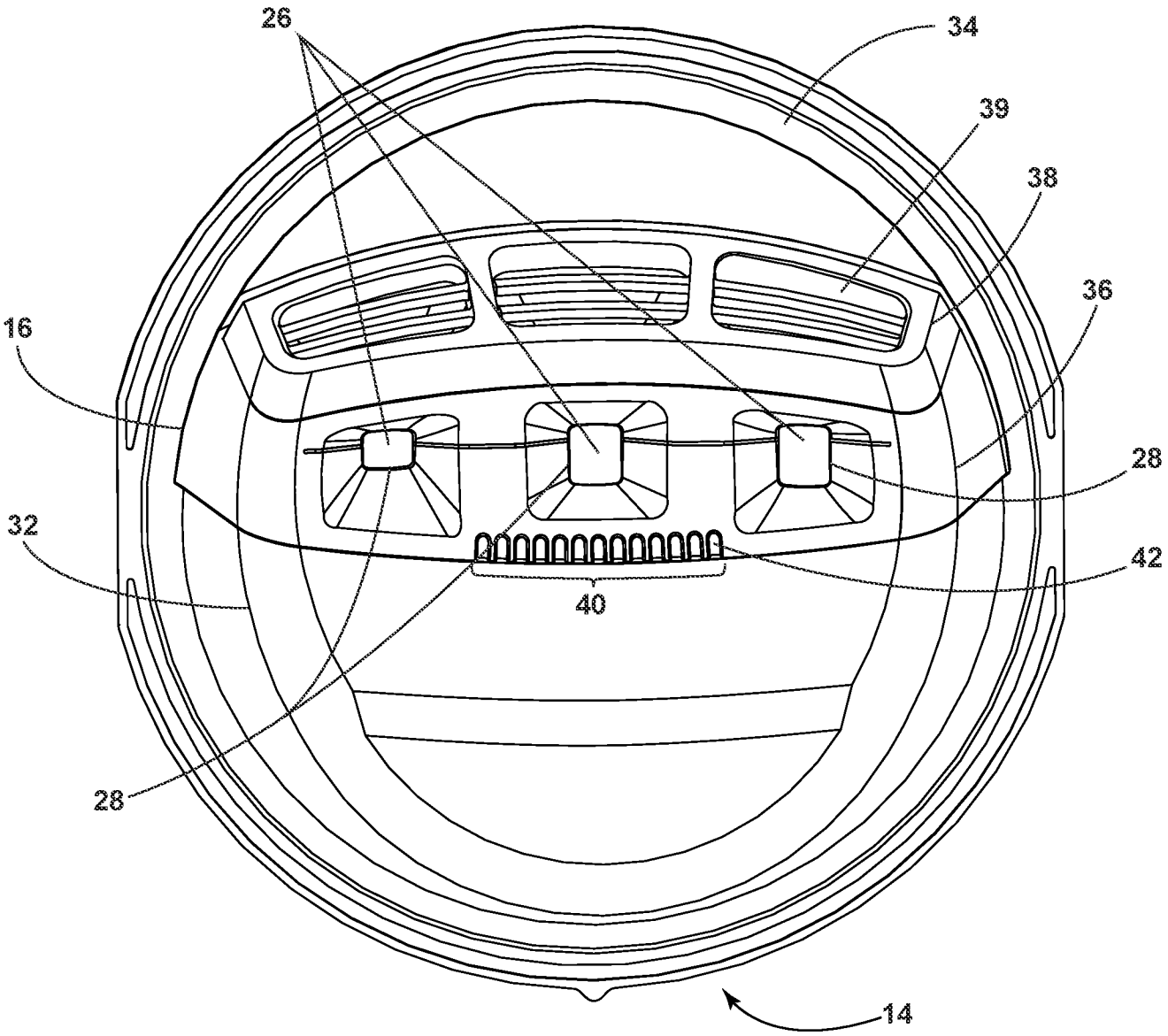
FIG. 2 is a front view of a rear face of the door of the laundry treating appliance of FIG. 1 with an integrated dispenser having multiple open-top reservoirs or cups.

Referring to FIG. 2, the door 8 can optionally include a transparent window 32 disposed at a central portion and a frame 34 installed at an edge portion defining the door 8. The transparent window 32 is made of a transparent material so that the user can see the inside of the treating chamber 12 through the door 8 during the washing operation.

The dispenser 16 is formed integrally with the rear face 14 of the door 8, particularly with the top rear facing portion of the transparent window 32 extending towards the access opening 10 of the treating chamber 12. The dispenser 16 has a housing 36 supporting a plurality of treating chemistry reservoirs 26.

The multiple reservoirs 26 are fluidly isolated from each other so that various kinds of treating chemistries can be provided in the different reservoirs without inter-mixing. Each reservoir 26 may be made of transparent material and openings forming windows 28 are provided for viewing the reservoir 26 to visually determine treating chemistry levels within the reservoirs 26.

The dispenser 16 can have a chamber lid 38 provided with an opening covering the opened top 39 of the treating chemistry reservoirs. The chamber lid 38 may be formed integrally with the dispenser 16, or detachably connected to the dispenser 16.

An outlet 40 is formed integrally at the lower portion of the dispenser housing 36 to guide the liquid containing the chemistry into the interior of the treating chamber 12. The outlet 40 is partitioned into a plurality of small openings 42 so that the dissolved detergent water is uniformly supplied to the interior of the treating chamber.

Figure 3:
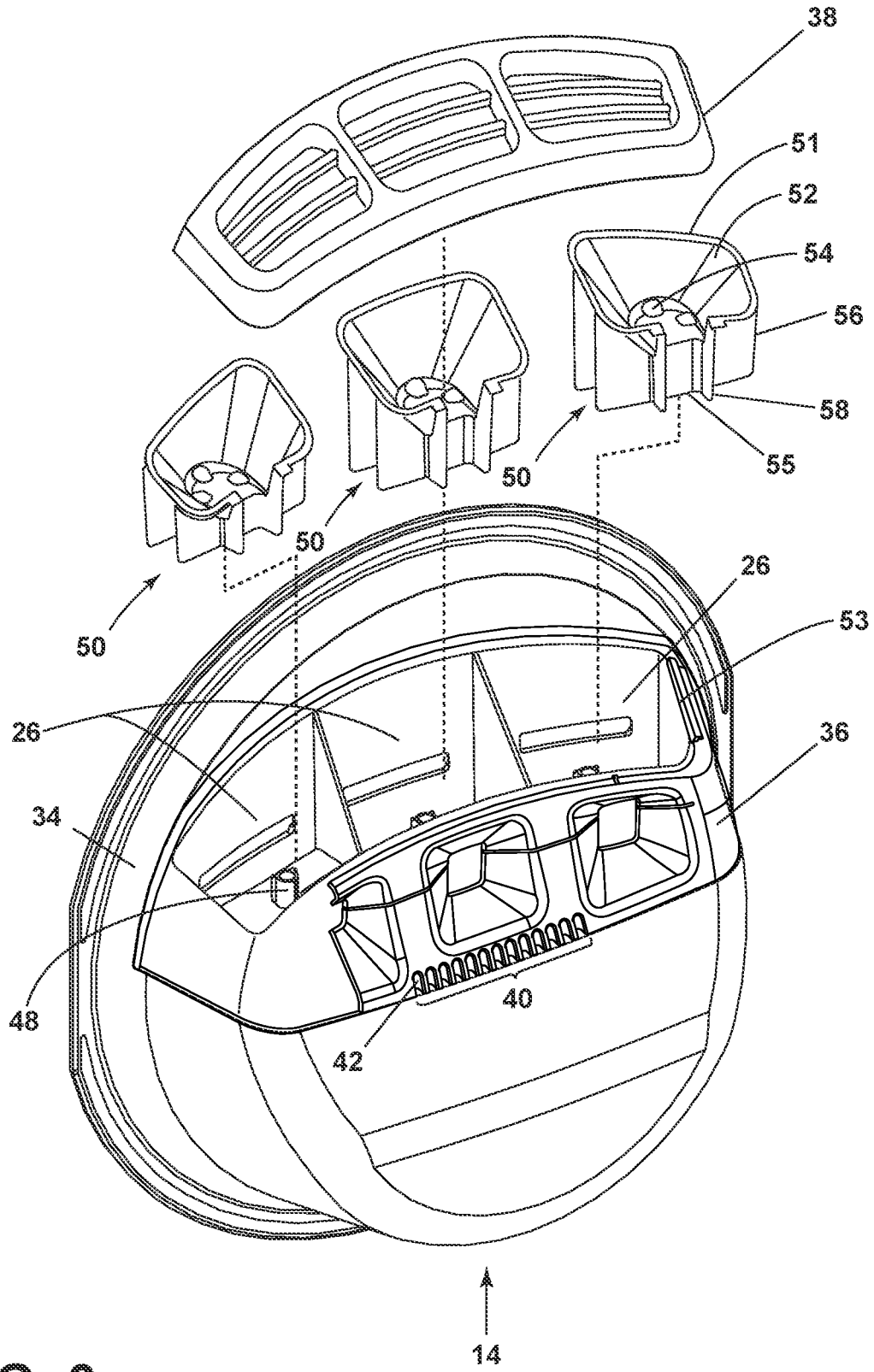
FIG. 3 is an exploded, perspective view of the dispenser of FIG. 2.

Referring to FIG. 3, the major elements of the dispenser 16 will be described in greater detail. The major elements in this dispenser 16 include a plurality of reservoirs 26, dispenser housing 36, and siphon cap 50. The three reservoirs 26 arranged side-by-side. The reservoirs 26 can be formed integrally with the dispenser housing 36, or connected detachably to the dispenser housing 36. As illustrated, they are detachably mounted. Each reservoirs 26 utilizes a siphon comprising a siphon tube 48 extending upwardly from a base of the reservoir 26 and a siphon cap 50 received in an open top 53 of the reservoir 26 by a trim bezel 51. The siphon tube 48 is integrated to the base of the reservoir 26 and fluidly coupling the reservoir with the dispenser housing.

The siphon cap 50 has a funnel 52 closing the open top 53 of the reservoir wherein the funnel 52 has at least one opening 54 fluidly coupling the funnel 52 to the reservoir 26. The siphon cap 50 has at least one baffle 56 extending laterally relative to the rear face 14. The laterally extending baffles 56 span the width of the reservoir 26.

As illustrated, the siphon cap 50 has two baffles 56 extending laterally relative to the rear face 14. The two baffles 56 are also on the opposite sides of the siphon tube 48 when the siphon cap 50 is received in the open top 53. Other baffles can be provided. For example baffles, such as a third baffle 58, extends transversely from the laterally extending baffles. When the siphon cap 50 is received within the reservoir 26, the baffles retard the flow of liquid within the reservoir 26.

Figure 4:
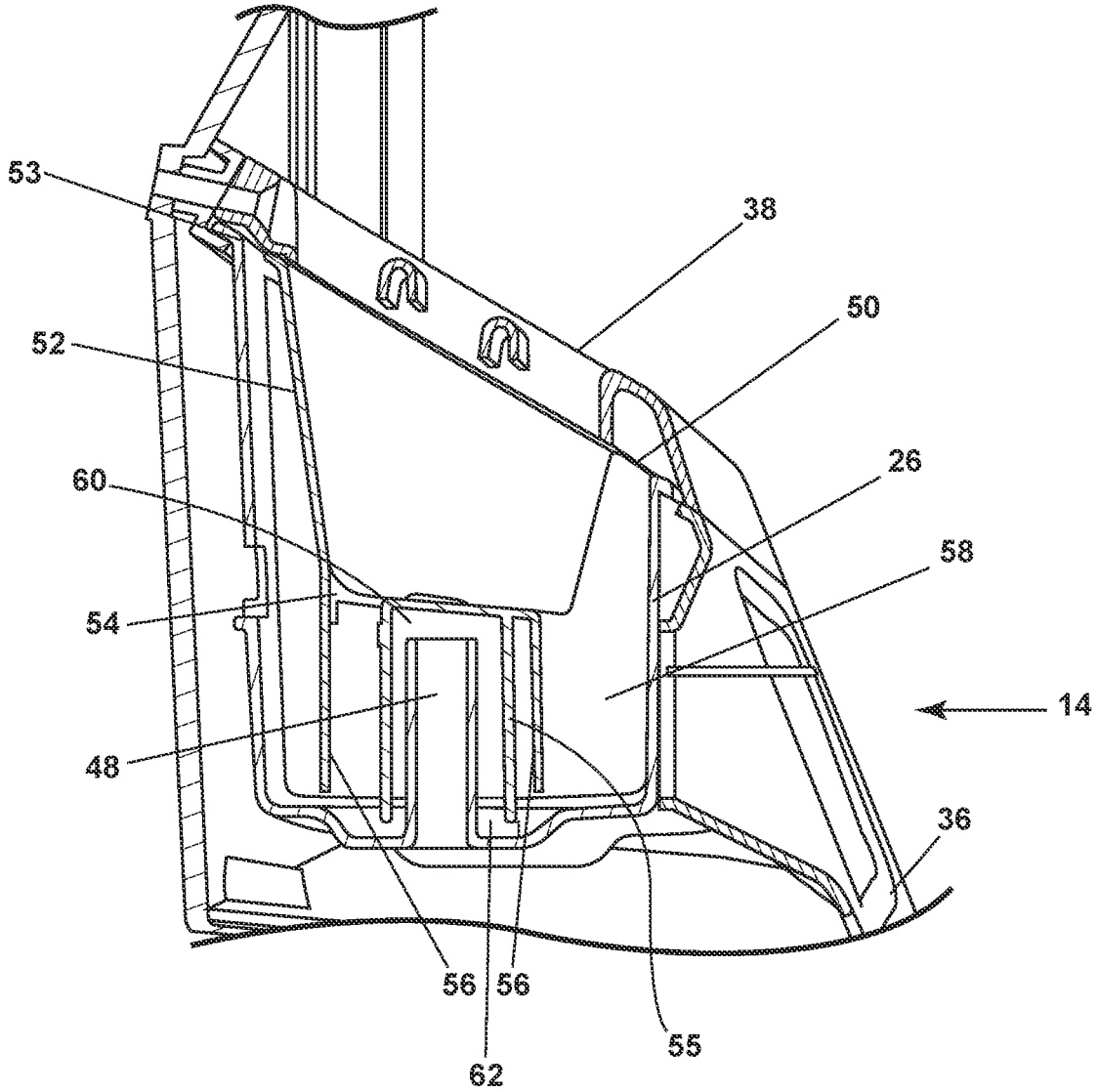
FIG. 4 is a sectional view of one of the open-top reservoirs with a siphon tube and a siphon cap received in the open top of the reservoir.

Referring to FIG. 4, the details of the siphon cap 50 and siphon tube 48 within the reservoir will be described in greater detail.

The siphon cap 50 has a collar 55 that extends around the siphon tube 48 when the siphon cap 50 is received within the reservoir 26. When the collar 55 extends around the siphon tube 48, a space is formed therebetween and defines a siphon channel 60.

To maintain the space, at least one protruding rib 62 can be disposed on the lower outer circumferential surface of the siphon tube 48 in a radial direction. The rib structure 62 spaces the outer circumferential surface of the siphon tube 48 from the inner circumferential surface of the siphon cap 50 to form the space, and separate the siphon cap 50 from the base of the treating chemistry reservoir 26 by a predetermined distance.

The siphon cap 50 with its funnel 52 structure functions to close and seal the open top 53 of the reservoir opening to prevent any fluids from leaking out of the top of the dispenser 16. The baffles 56 extending laterally relative to the rear face 14 are disposed transversely to the path of travel 30 of the door in order to prevent sloshing of treating chemistry from the inertial forces created from the door 8 closing or opening motion.

Figure 5:
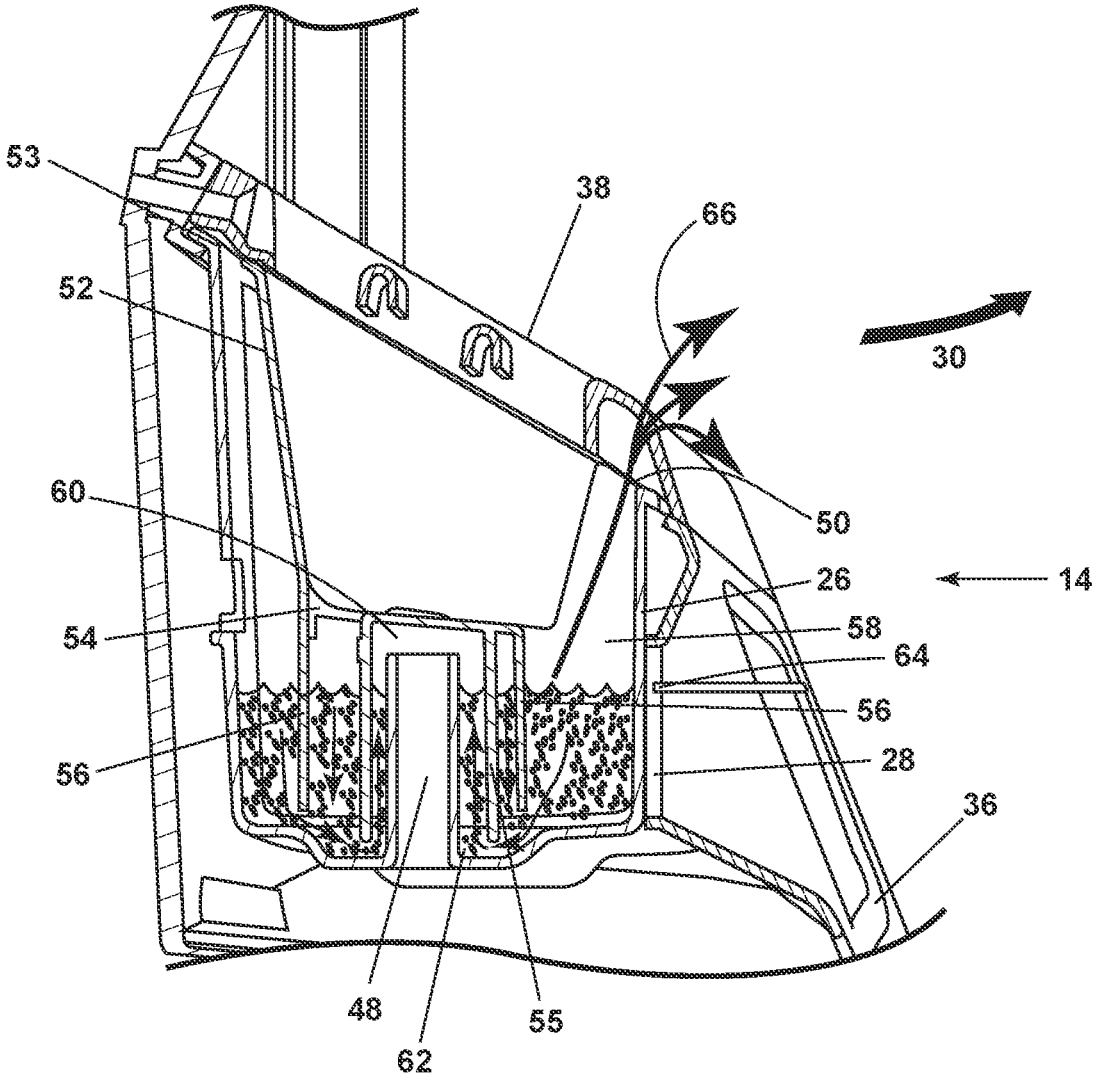
FIG. 5 is the same as FIG. 4 along with illustrated fluid levels relative to the internal structure of the open-top dispenser reservoir.

FIG. 5 illustrates the functional utility of the siphon cap 50 when the reservoir is filled with a treating chemistry. In this illustration, treating chemistry will be introduced into the dispenser 16 via the openings of the chamber lid 38 into the funnel 52 of the siphon cap 50. The treating chemistry will then flow through the funnel opening 54 that fluidly couples the funnel 52 to the reservoir 26 and starts to fill the cavity within the reservoir 26 including the spaces between the inner surface of the siphon cap 50 and the outer circumferential surface of the siphon tube 48. As is seen, the treating chemistry reaches a predetermined level 64, which is anticipated to be at the level demarked on the reservoir window 28.

The orientation of the laterally extending baffles 56 will break the inertial waves created when the door travels along the path of travel 30, thus minimizing; the sloshing motion 66 of the treating chemistry.

With the plurality of baffles 56 extending laterally and baffles 58 extending transversely, the fluids within the reservoir 26 are compartmentalize into smaller sectional volume, thus reducing the overall inertial wave created when the door 8 is in motion.

Although the embodiment of the present invention have been shown and described, it would be appreciated by those skilled in the art that changes may be made in these embodiments without departing from the principles and spirit of the invention, the scope of which is defined in the claims and their equivalents.

What is claimed is:

1. A laundry treating appliance for treating laundry according to an automatic cycle of operation, comprising:

a cabinet defining an interior with an opening providing access to the interior;

a treating chamber located within the cabinet and accessible by the opening;

a dispenser having at least one reservoir with a base and an open top and a siphon tube extending from the base and fluidly coupled to the treating chamber; and a siphon cap received in the open top of the reservoir, the siphon cap comprising:

a funnel having an upper edge closing the open top, the funnel extending between an inlet at least partially defined by the upper edge and an outlet at least partially defined by a lower edge of the funnel, the lower edge of the funnel at least partially forming a bottom of the funnel, and a collar extending from and below the bottom of the funnel around the siphon tube.

2. The laundry treating appliance of claim 1, further comprising at least one baffle extending away from the collar into the at least one reservoir.

3. The laundry treating appliance of claim 2 wherein the at least one baffle extends laterally from opposite sides of the siphon tube.

4. The laundry treating appliance of claim 3 wherein the at least one baffle comprises another baffle extending from the laterally extending baffle.

5. The laundry treating appliance of claim 1, further comprising a window located on the dispenser and providing a view of at least a portion of the at least one reservoir.

6. The laundry treating appliance of claim 5 wherein the window forms part of the reservoir.

7. The laundry treating appliance of claim 5 wherein the reservoir is made from transparent material.

8. The laundry treating appliance of claim 7 wherein the window comprises an opening in the dispenser, with the opening aligned with the reservoir.

9. The laundry treating appliance of claim 1 wherein the funnel has at least one opening in the bottom fluidly coupling the funnel to the reservoir.

10. The laundry treating appliance of claim 1 wherein the dispenser comprises multiple reservoirs with siphon tubes and a respective siphon cap for each of the siphon tubes.

11. The laundry treating appliance of claim 10 wherein the multiple reservoirs are arranged side-by-side.

12. A dispenser for a household appliance for treating an article according to an automatic cycle of operation, the dispenser comprising:

at least one reservoir with a base and an open top;

a siphon tube extending from the base; and a siphon cap received in the open top of the reservoir, the siphon cap comprising:

a funnel having an upper edge closing the open top, the funnel extending between an inlet at least partially defined by the upper edge and an outlet at least partially defined by a lower edge of the funnel, the lower edge of the funnel at least partially forming a bottom of the funnel, and a collar extending from and below the bottom of the funnel around the siphon tube.

13. The dispenser of claim 12, further comprising at least one baffle extending away from the collar into the at least one reservoir.

14. The dispenser of claim 13 wherein the at least one baffle extends laterally from opposite sides of the siphon tube.

15. The dispenser of claim 14 wherein the at least one baffle comprises another baffle extending from the laterally extending baffle.

16. The dispenser of claim 12, further comprising a window providing a view of at least a portion of the at least one reservoir.

17. The dispenser of claim 16 wherein the window forms part of the reservoir.

18. The dispenser of claim 17 wherein the window comprises an opening in the dispenser, with the opening aligned with the reservoir.

19. The dispenser of claim 12 wherein the funnel has at least one opening in the bottom fluidly coupling the funnel to the reservoir.

20. The dispenser of claim 12, further comprising multiple reservoirs with siphon tubes and a respective siphon cap for each of the siphon tubes.

* * * * *